US008756722B2

(12) United States Patent
Inglin et al.

(10) Patent No.: US 8,756,722 B2
(45) Date of Patent: Jun. 24, 2014

(54) FLUSHING DEVICE FOR FLUSHING A TOILET BOWL, WATER CLOSET HAVING SUCH A FLUSHING DEVICE, AND TOILET BOWL

(75) Inventors: Urs Inglin, Lachen (CH); Reto Lienin, Horgen (CH)

(73) Assignee: Geberit International AG, Jona (CH)

( * ) Notice: Subject to any disclaimer, the term of this patent is extended or adjusted under 35 U.S.C. 154(b) by 808 days.

(21) Appl. No.: 12/963,141

(22) Filed: Dec. 8, 2010

(65) Prior Publication Data

US 2011/0131716 A1 Jun. 9, 2011

(30) Foreign Application Priority Data

Dec. 9, 2009 (EP) ..... 09405215

(51) Int. Cl.
*E03D 11/08* (2006.01)
*E03D 11/02* (2006.01)

(52) U.S. Cl.
CPC ..... *E03D 11/02* (2013.01); *E03D 2201/30* (2013.01); *E03D 2201/40* (2013.01)
USPC ..... 4/420; 4/421; 4/425; 4/431

(58) Field of Classification Search
CPC ..... E03D 11/02; E03D 11/14; E03D 2201/30; E03D 2201/40
USPC ..... 4/420, 421, 425, 431
See application file for complete search history.

(56) References Cited

U.S. PATENT DOCUMENTS

| | | | |
|---|---|---|---|
| 6,145,138 | A | 11/2000 | Nakamura et al. |
| 6,651,266 | B1 | 11/2003 | Liu et al. |
| 7,096,517 | B2 | 8/2006 | Gubeli et al. |
| 2003/0088910 | A1 | 5/2003 | Hidetaka et al. |
| 2006/0005310 | A1 | 1/2006 | Nakamura et al. |

FOREIGN PATENT DOCUMENTS

| | | | |
|---|---|---|---|
| DE | 202006012072 | U1 | 8/2007 |
| FR | 2874038 | A1 | 2/2006 |

*Primary Examiner* — Tuan N Nguyen
(74) *Attorney, Agent, or Firm* — Sughrue Mion, PLLC

(57) ABSTRACT

The flushing device has a flushing tank (28), from which a quantity of flushing water can be fed to the toilet bowl (6). This flushing water quantity is divided into a part-quantity for cleaning an upper region of the toilet bowl (6) and a further part-quantity for moving water which is present in the toilet bowl (6). Means (30) are provided, with which the flushing water quantity is divided into at least three part-quantities. With a first part-quantity at least an upper region (A) of the inner side of the toilet bowl (6), and with a second part-quantity a middle region (B) of the inner side of the toilet bowl (6) is cleanable, and with a third part-quantity a siphon trap (12) of the toilet bowl (6) can be flushed and cleaned. The flushing device enables a more thorough cleaning of the toilet bowl with comparatively little water.

12 Claims, 4 Drawing Sheets

Figure 1:
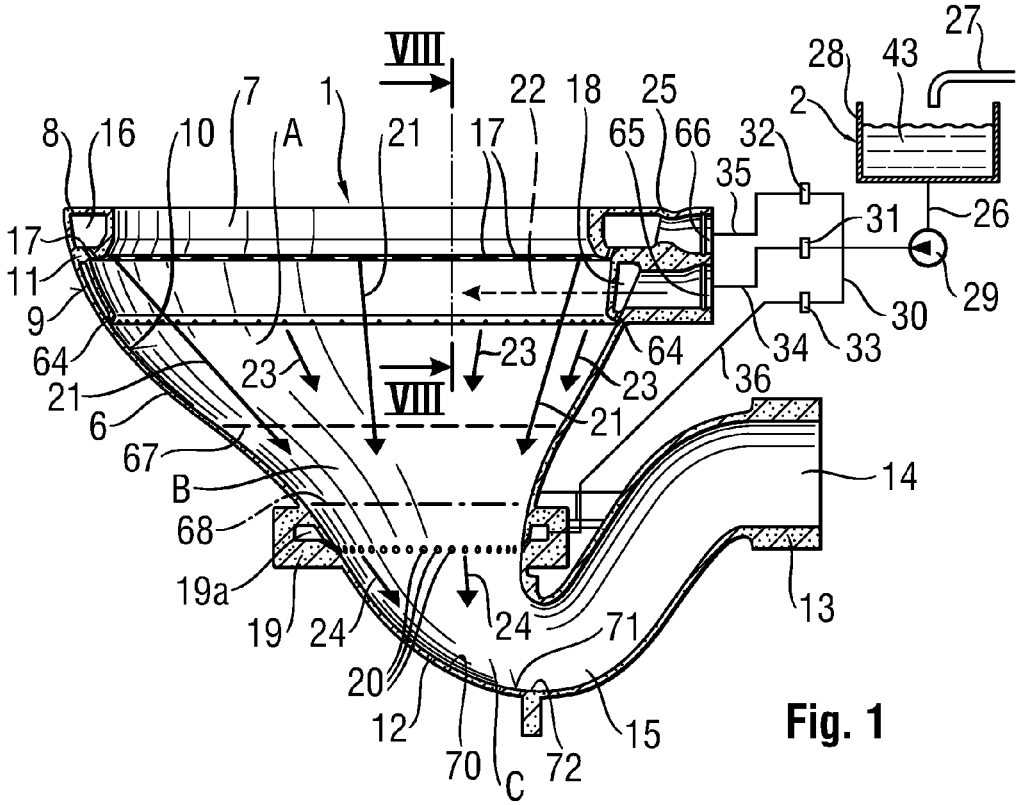

FLUSHING DEVICE FOR FLUSHING A TOILET BOWL, WATER CLOSET HAVING SUCH A FLUSHING DEVICE, AND TOILET BOWL

The invention relates to a flushing device for flushing a toilet bowl, having a flushing tank, from which a quantity of flushing water can be fed to the toilet bowl, this flushing water quantity being divided into a part-quantity for cleaning an upper region of the toilet bowl and a further part-quantity for moving water which is present in the toilet bowl. The invention further relates to a water closet having such a flushing device, and to a toilet bowl.

Flushing devices of this type have long been known. In a flushing operation, the components present in the siphon trap are flushed into the waste disposal line, the inner side of the toilet bowl is cleaned and, finally, the siphon trap is refilled with water. It has long been the object of such flushing devices to be able to conduct the flushing operation and the cleaning of the toilet bowl as efficiently as possible and with least possible water. The effectiveness of the flushing operation can be improved in a known manner by providing a so-called jet nozzle in the siphon trap. A part of the flushing water is fed under comparatively high pressure to this jet nozzle. Another part-quantity is conducted to a flushing channel, which has a plurality of nozzles through which the flushing water for cleaning the inner side of the toilet bowl is delivered.

A flushing device of the said type has been disclosed, for example, by WO 2009/000881. The water present in the flushing tank is fed to a pump, which feeds a part of the water to a flushing channel and another part to a jet nozzle disposed in a siphon trap.

The object of the invention is to provide a flushing device of the said type which enables the toilet bowl to be cleaned and flushed yet more thoroughly. This should be possible with a comparatively small quantity of flushing water. Likewise, a toilet bowl should be provided which can be cleaned particularly thoroughly and with least possible water.

The object is achieved by providing means with which the flushing water quantity is divided into at least three part-quantities. The division of the flushing water quantity into at least three part-quantities enables the inner side of the toilet bowl to be cleaned yet more purposefully in at least three different regions and the flushing operation to be initiated. The invention is founded on the recognition that the inner side of a toilet bowl can generally be divided into three regions which are soiled to varying extent. An upper region is comparatively lightly soiled and here it is sufficient to wet the inner side of the toilet bowl. This can be done using comparatively low water pressure and a comparatively small quantity of flushing water. This region can be cleaned with a first part-quantity of the flushing water. The flushing tank can be as a cistern having an inlet and an outlet valve, though other flushing tanks are also conceivable in this case.

A second region which suffers medium-heavy soiling is located beneath the said upper region. This region can be purposefully cleaned with the second part-quantity of water. Compared with the first part-quantity, a higher water pressure and also a higher water quantity is here provided.

A third region is located on the inner side in the siphon trap. This region is generally soiled the heaviest. It also contains the materials which are to be removed. The cleaning and the flushing operation can be conducted with the third part-quantity. The water pressure which is provided here is yet higher than the water pressure of the second part-quantity. Moreover, the volume of this third part-quantity can also be higher than the volumes of the two other part-quantities.

For the cleaning and flushing of a toilet bowl, the device according to the invention hence allows three different regions to be cleaned and flushed with different part-quantities and different water pressures. The three part-quantities can be optimally tailored to the functions to be fulfilled or to the different regions. This is likewise true of the respective time of the triggering. Given appropriate optimization, it is possible with the flushing device according to the invention to achieve a cleaning which requires no follow-up cleaning, for example with a brush. This is possible with a comparatively small quantity of flushing water, for example with about 4 liters or less.

According to one refinement of the invention, it is provided that the second part-quantity is delivered with a higher pressure than the first part-quantity, and the third part-quantity with a higher pressure than the second part-quantity. The pressure of these part-quantities can be tailored particularly expediently to the different functions.

According to one refinement of the invention, it is provided that the first part-quantity is delivered by virtue of gravitational force. This part-quantity is hence delivered without pressure build-up, for example by means of a pump.

According to one refinement of the invention, it is provided that it has a pump which serves to deliver at least a part of the flushing water quantity under pressure to the toilet bowl. According to one refinement of the invention, substantially the entire quantity of flushing water is stored under pressure prior to delivery. The water quantity is then delivered, for example, at a branch junction into three different lines. Flushing currents and cleaning currents with different pressure are then generated, for example, with adjustable valves. In particular, it is provided that, according to one refinement of the invention, a first, a second and a third valve are provided. These valves are then adjusted in accordance with the designated pressures. The valves can be adjustable in a controlled manner and by means of a control device. It is thereby easily possible to achieve an optimal division of the three part-quantities and also an optimal allocation of the different pressures and volumes.

According to one refinement of the invention, it is provided that a pump is provided, which pump is operated with a turbine driven by the water of a water pipe. The flushing device according to the invention can then be operated in a particularly energy-saving manner. Connections, for example electrical connections, can be avoided. By means of the turbine, it is also possible to actuate a pressure reservoir, for example of the kind having a pressure spring piston. The pump, or such a pressure spring piston, can also be actuated with a motor, for example.

According to one refinement of the invention, the first part-quantity is delivered by means of a flushing ring. This flushing ring is located in an upper region of the toilet bowl. According to one refinement of the invention, this flushing ring possesses a circumferential gap, at which the flushing water is delivered under comparatively high pressure in order to wet the inner side of the toilet bowl. For the delivery of the second part-quantity, a flushing channel, likewise disposed in an upper region of the toilet bowl, is provided. This flushing channel is preferably provided with a plurality of nozzle openings, which are directed towards the said middle region. According to one refinement of the invention, this flushing channel is disposed above the flushing ring. The flushing ring and the flushing channel are respectively provided, according to one refinement of the invention, such that they have a separate connection for the reception of the corresponding part-quantities.

For the delivery of the third part-quantity, a ring nozzle, which is disposed in a lower region and preferably at roughly the height of the trap water level, is preferably provided. This ring nozzle preferably possesses a plurality of nozzle openings or a circumferential gap, through which the flushing water is delivered with comparatively high pressure into the siphon trap. The flushing water delivered through the ring nozzle accelerates the water present in the siphon trap, and the components contained therein, at the same time as the inner side of the siphon trap is thoroughly cleaned.

The refilling of the siphon trap with water is preferably realized by means of the flushing ring, and hence with water which is delivered with comparatively low pressure into the toilet bowl. With the delivery of this water, the inner side of the toilet bowl is cleaned once again.

The invention further relates to a water closet having such a flushing device, and to a toilet bowl.

Further features and advantages of the invention emerge from the dependent patent claims, the following description and the drawing.

Figure 2A:
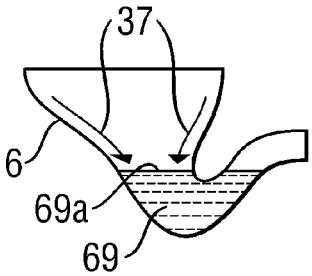
Figure 2B:
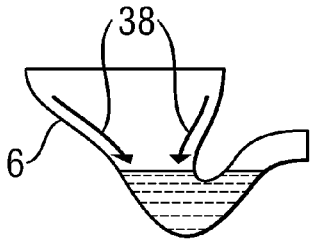
Figure 2C:
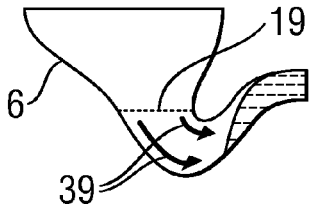
Figure 2D:
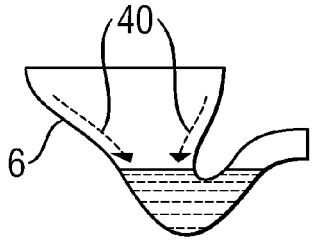
Figure 3:
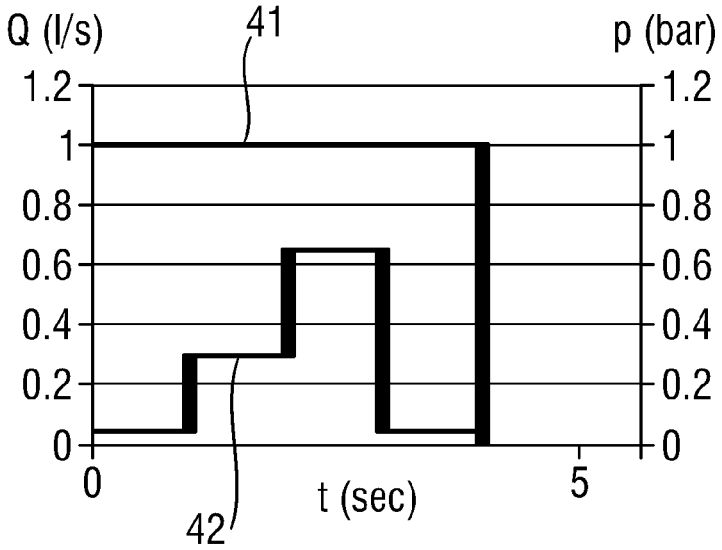
Figure 4:
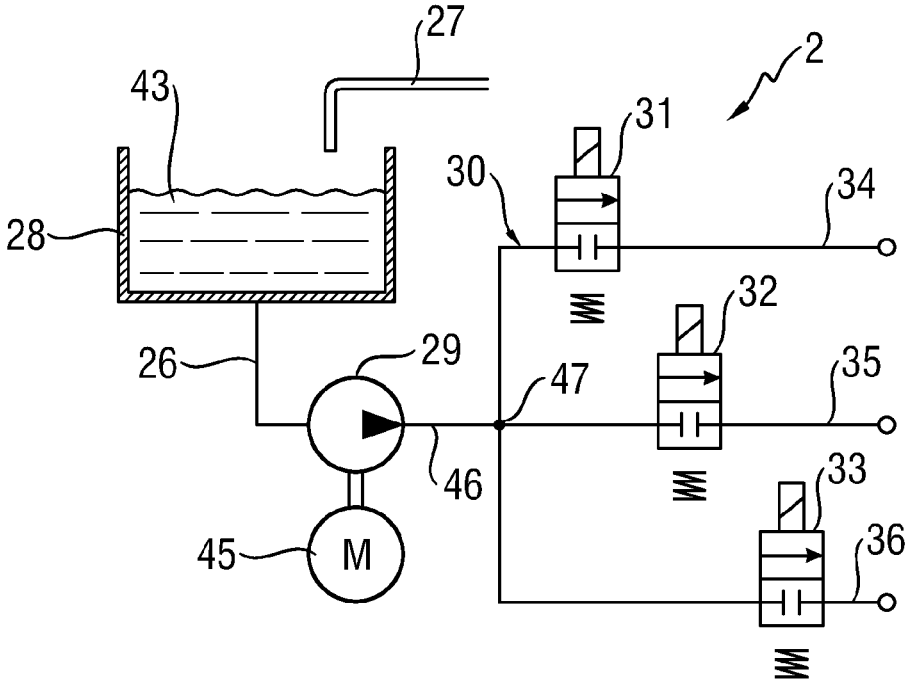
Figure 5:
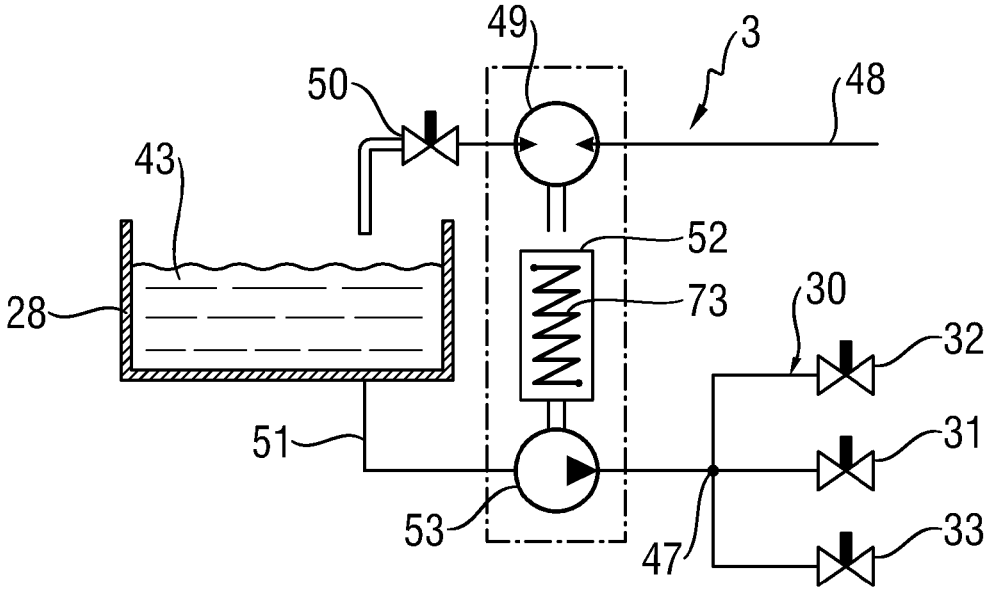
Figure 6:
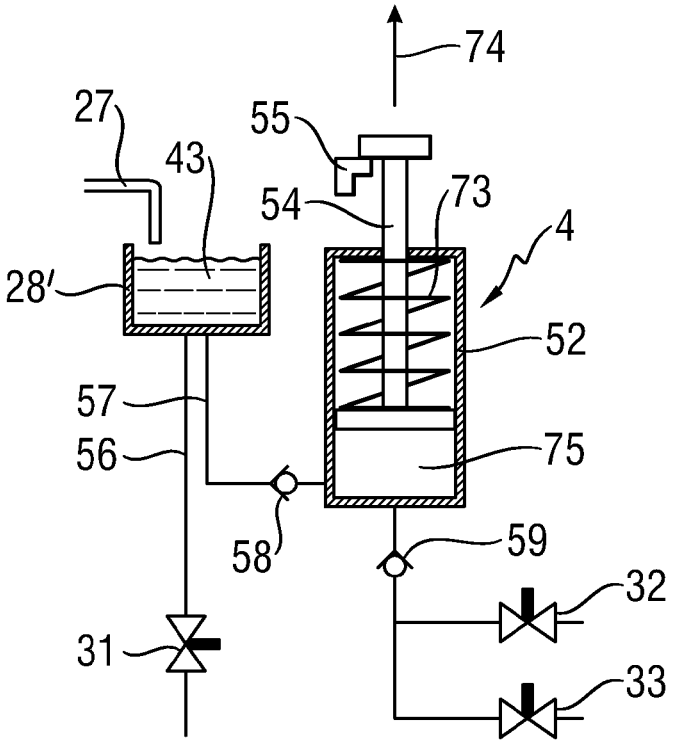
Figure 7:
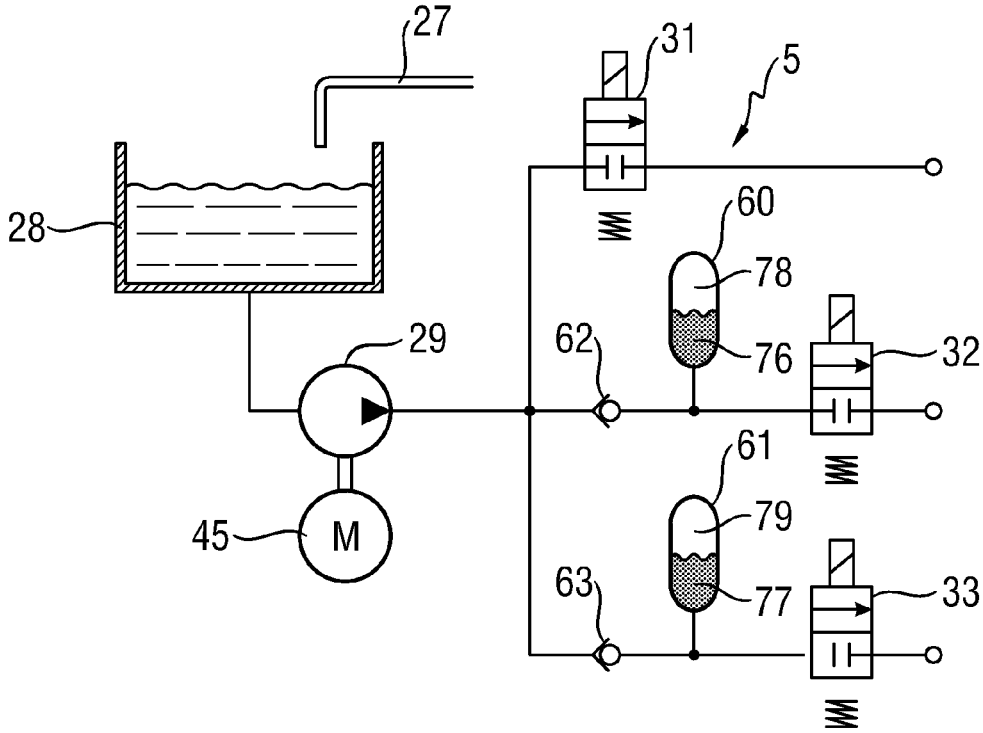
Figure 8:
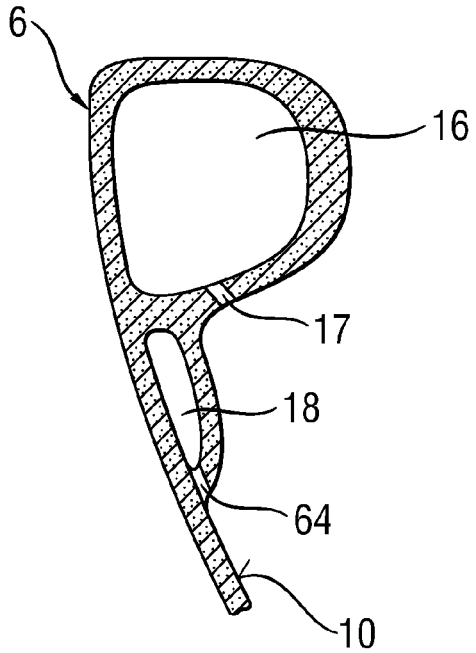

Illustrative embodiments of the invention are explained in greater detail below with reference to the drawing, in which:

FIG. 1 shows schematically a section through a water closet according to the invention, FIGS. 2*a*-2*d* show schematically the course of the individual flushing currents and cleaning currents in the toilet bowl, FIG. 3 shows a pressure and volume chart for representing the pressure pattern and the flushing quantity as a function of time, FIG. 4 shows schematically a flushing device according to the invention according to a first variant, FIG. 5 shows schematically a flushing device according to the invention according to a second variant, FIG. 6 shows schematically a flushing device according to the invention according to a third variant, FIG. 7 shows schematically a flushing device according to the invention according to a fourth variant, and FIG. 8 shows a section through the toilet bowl along the line VIII-VIII of FIG. 1.

The water closet 1 shown in FIG. 1 possesses a flushing device 2, which is intended to flush and clean a toilet bowl 6. The flushing device 2 possesses a flushing tank 28 for the storage of flushing water 43. The flushing tank 28 can be provided in the usual manner with an actuating device (not shown here), for triggering a flush, and an outlet valve. In order to refill the flushing tank 28 after a flush, it is connected to a water pipe 27. When a flush is made, the water makes its way via a line 26 to a pump 29, in which the flushing water is placed under a designated pressure. From here, the water is delivered to a distributing device 30, which delivers the flushing water to a first valve 31, a second valve 32 and a third valve 33. These valves 31 to 33 are preferably adjustable, so that finally three different part-quantities of the flushing water can be delivered to the toilet bowl 6. The valves 31 to 32 are manually adjustable valves or electrovalves, which are connected to a control device (not shown here). The pump 29 can be disposed outside or within the flushing tank 28. A cistern, which is a pressure cistern or which contains a device in which a part of the flushing water 43 is put under pressure, as disclosed in U.S. Pat. No. 7,096,517 of the applicant, is also conceivable.

That part-quantity of the flushing water which is delivered in a flush via the valve 31 makes its way via a first line 34 to a connecting socket 65 of a connection 25 of the toilet bowl 6. This connecting socket 65 is suitable, for example, for a plug connection to the first line 34. From the connecting socket 65, the said first part-quantity makes its way into a flushing ring 18, which is configured circumferentially on an inner side 10 of the toilet bowl 6 in accordance with the cross section in this region of the toilet bowl 6. According to FIG. 8, the flushing ring 18 is provided in a lower region with an outlet 64, which can be formed by a gap or by a plurality of nozzle-shaped openings. The water flowing downwards through the outlet 64 runs down along the inner side 10 and finally makes its way into a siphon trap 12. The inner side 10 is thereby wetted and cleaned in an upper region A and in a middle region B. The upper region A is a region of the inner side 10 which usually suffers comparatively little soiling. By contrast, the middle region B is a region of the inner side 10 which is generally more heavily soiled than the upper region A. In FIG. 1, the place where roughly the region A passes into the region B is denoted with the line 67. The region B passes roughly at the height of the dash-dot line 68 into a lowermost, generally heavily soiled region C. The line 68 is located roughly at the height of the trap water level. Hence the regions A and B are wetted, and the region A is substantially fully and the region B at least partially cleaned, by the flushing water quantity delivered out of the flushing ring 18.

In FIG. 2*a*, the flushing current delivered through the flushing ring 18 is indicated with arrows 37. Also indicated is the trap water 69 and, with a line, the level 69*a* of the trap water.

The flushing water which is delivered in a flush through the second valve 32 makes its way via a second line 35 to a connecting socket 66 of the connection 25. From the connecting socket 66, the second part-quantity of the flushing water makes its way into a flushing channel 16, which is disposed on an upper rim 8 of the toilet bowl 6. The flushing channel 16 is located above the flushing ring 18 and likewise extends preferably over the total circumference of the rim 8. The flushing channel 16 forms with the upper rim 8 an opening 7 of the toilet bowl 6. In a lower region, the flushing channel 16 is open at a plurality of nozzle openings 17, so that this second part-quantity can be delivered through these nozzle openings 17 to the toilet bowl 6. The nozzle openings 17 form a second outlet and are directed such that the outflowing water strikes the inner side 10 with comparatively high energy in the region B. In a flushing operation, a number of jets are formed, which are purposefully directed towards the region B and which clean this region B. The volume of the second part-quantity is preferably greater than the volume of the first part-quantity and preferably also possesses a higher pressure. Hence, for the cleaning of the region B, a higher pressure and a higher volume of the flushing water is preferably used. The delivery of these two part-quantities can also be time-staggered. In particular, it is provided that the first part-quantity is delivered in advance of the second part-quantity. It is also conceivable, however, for both part-quantities to be delivered essentially simultaneously and hence synchronously. In FIG. 1, the direction in which the first part-quantity flows into the flushing ring 18 is indicated with the arrow 22. The arrow 23 indicates the direction in which the second part-quantity flows into the toilet bowl 6. The arrows 21 indicate the direction of the water jets with which the region B is cleaned.

The water delivered by the third valve 33 forms a third part-quantity, which is delivered via a third line 36 to a ring nozzle 19. This ring nozzle 19 is disposed on an outer side 9 of the toilet bowl 6 and is likewise circumferential in configuration. The ring nozzle 19 possesses a socket (not shown further here), at which the third line 36 can be connected, for example, in a pluggable manner to the ring nozzle 19. Within the ring nozzle 19 runs a circumferential channel 19*a*, which is connected to a plurality of nozzle openings 20. In the event of a flush, this third part-quantity flows through these nozzle openings 20, which form a third outlet, in the direction of the arrows 24 into the siphon trap 12. The water jets leaving the nozzle openings 20 are preferably directed towards a point 70 on an inner side 71 of the siphon trap 2. The point 70 is located somewhat before the lowest point 72 of the siphon trap 12. At this point 70, the impinging water is reflected and accelerates the water present in the siphon trap 12 in the direction of an outlet opening 14 of a trap socket 13. The water flowing out of the nozzle openings 20 and the reflected water also clean the inner side 71 of the siphon trap 12. The third part-quantity thus effects a flushing and also a cleaning of the inner side 71. The third part-quantity flows in the third line 36 with a pressure which is substantially higher than the pressure of the second part-quantity in the second line 35. Moreover, the volume of the third part-quantity is greater than the volume of the second part-quantity. The flushing water quantity which is in total available for the flushing is thus divided substantially into three part-quantities, which are tailored to the regions A, B and C in terms of volume and pressure.

After the siphon trap 12 has been flushed and emptied, it is refilled with water. This water flows preferably through the flushing ring 18 into the toilet bowl 6. This water cleans once again the inner side 10 in the regions A, B, and at least partially the region C. This refilling is indicated in FIG. 2*d* with the arrows 40. FIG. 2*b* shows with arrows 38 the influx of the second part-quantity, and FIG. 2*c* shows with arrows 39 the influx of the water of the third part-quantity.

As shown by FIG. 4, the pump 29, which is driven by a motor 45, is connected to a branch junction 47 by a line 46. After a flush has been triggered, the pump 29 conveys water through the line 46 to the branch junction 47. From this, the water is conveyed to the distributing device 30, which has the above-stated valves 31, 32 and 33. The valves 31 to 33 possess, in accordance with the designated pressures, different admission openings, which can be adjustable. These are chosen such that the pressure in the first line 34 is lowest, since the water passing through the first line 34 is intended merely for wetting the regions A and B.

The pressure in the line 35 is greater, and the water flowing through this is intended for cleaning of the region B. The pressure is highest in the third line 36, since the water is intended for the ring nozzle 19, through which water is introduced with comparatively high energy into the siphon trap 12. A preferred optimal flushing process is explained in greater detail below with reference to FIG. 3.

FIG. 3 shows with a volume curve 41 the flushing quantity per unit of time. This is substantially constant and amounts, for example, to one liter of water per second. The entire flushing operation lasts about four seconds. The total quantity of flushing water is hence about four liters of water. A pressure curve 42 shows the pressure pattern during the flushing operation. During the first second, the pressure is comparatively small, for example less than 0.1 bar. In this first phase, according to FIG. 2*a*, the water flows through the openings 64 down along the inner side 10 and cleans the inner side 10 in the regions A and B. In a second phase, which is shown in FIG. 2*b*, the region B is cleaned with increased pressure by the water flowing out of the nozzle openings 17. The pressure is in this case preferably greater than 0.2 and less than 0.4 bar and, for example, 0.3 bar. Smaller or higher pressures are here also conceivable, however. The pressure during this second phase is preferably greater than 0.1 bar and less than 0.5 bar. In a third phase, the pressure is highest and amounts to, for example, 0.6 bar. With this pressure, water is delivered through the nozzle openings 20 into the siphon trap 12. As already explained above, the corresponding water jets are focused on a point 70 on the inner side 71 of the siphon trap 12. The water flowing into the siphon trap thus possesses a comparatively high energy and can thereby empty the siphon trap 12 and clean it thoroughly, in particular by turbulences. The water, and components contained therein, are thereby conveyed at the trap socket 13 through the outlet opening 14 into the waste disposal line (not shown here).

In a fourth phase, the emptied siphon trap 12 is refilled with water, according to FIG. 2*d*. The water makes its way with correspondingly low pressure through the openings 64 along the inner side 10 into the siphon trap 12, whereupon the regions A and B are cleaned once again. The third phase and the fourth phase are shown in FIGS. 2*c* and 2*d*. Once the cistern 28 is filled again with flushing water, 43, then the water closet 1 is ready for a further flush.

The flushing device 3 shown in FIG. 5 possesses a turbine 49, which is disposed in a pressure line 48. After the turbine 49 there is arranged an inlet valve 50, which, in order to trigger a rinse, can be opened in a known manner by means of an actuating device (not shown here). Once the inlet valve 50 is opened, then water flows through the line 48 into the flushing tank and fills this to a certain level. The turbine is driven by the through-flowing water. Energy is generated with the driven turbine 39, with which energy a spring 73 of an energy store 52 is tensioned. With the tensioned spring 73, the pump 53 can be driven or a piston (not shown here) can be loaded, for example. Through slackening of the spring 73 by means of a triggering device (not shown here), water present in the energy store 52 can be delivered under pressure to the distributing device 30. In this flushing device 3, the flushing process is the same as in the flushing device 2 described above.

FIG. 6 shows a flushing device 4, in which an energy store 52 is likewise provided. In place of the turbine 49, a motor (not shown here), for example an electric motor, can here also optionally be provided, with which motor a piston 54 is moved upwards in the direction of the arrow 74. The spring 73 is thereby tensioned. The piston 54 can be fixed in the tensioned position by means of a holding element 55, as is disclosed in U.S. Pat. No. 7,096,517. According to this, the energy store 52 can be disposed in the flushing tank 28. Two or three energy stores disposed in the flushing tank 28 are also possible. When the piston 54 is raised, water is drawn via a non-return valve 58 out of the flushing tank 28' into an interior space 75. If the holding element 55 is moved with an actuating device (not shown here) into a release position, then the piston 54 moves downwards by virtue of the tension of the spring 73 and pressurizes the water present in the interior space 75. This is thereby conveyed via a non-return valve 59 to the two valves 32 and 33. Via the valve 32 water makes its way to the flushing channel 16, and via the valve 33 water makes its way to the ring nozzle 19. The water provided above the flushing ring 18 makes its way out of the flushing tank 28' directly via a line 56 to the valve 31. The energy of this water is produced by gravitation by virtue of the height difference between the flushing tank 28' and the openings 64. The correspondingly comparatively small pressure is here sufficient, since, as mentioned, only the inner side 10 in the regions A and B is intended to be wetted. The pressure is also sufficient to refill the siphon trap 12. The movement of the piston 54 can be conducted with any suitable drive mechanism. In place of a motor, a turbine 49 or another suitable drive mechanism is here also conceivable. Once the siphon trap 12 is refilled and the piston 54 is in the raised position, then the flushing device 4 is ready for a further flush.

FIG. 7 shows a flushing device 5, which, viewed in the direction of flow, has before the valves 32 and 33 respectively a reservoir 60 and 61 and a non-return valve 62 and 63. Following a flush, the reservoirs 60 and 61 are filled with a water quantity 76 and 77. In the course of the filling, air 78 and 79 which is present in the reservoir 60 and 61 is tensioned. Prior to a flush, the two valves 32 and 33 are closed. If these valves 32 and 33 are opened, then, by virtue of the tensioned air 78 and 79, water is delivered through the opened valves 32 and 33. The water delivered through the first valve 31 is conveyed merely by the pump 39. Alternatively, the water delivered through the valve 31 could also make its way directly out of the flushing tank 28. In place of the motor 45, a turbine or another suitable drive mechanism is here too conceivable.

| REFERENCE SYMBOL LIST | |
|---|---|
| 1 | water closet |
| 2 | flushing device |
| 3 | flushing device |
| 4 | flushing device |
| 5 | flushing device |
| 6 | toilet bowl |
| 7 | opening |
| 8 | rim |
| 9 | outer side |
| 10 | inner side |
| 11 | body |
| 12 | siphon trap |
| 13 | trap socket |
| 14 | outlet opening |
| 15 | trap bend |
| 16 | flushing channel |
| 17 | nozzle opening |
| 18 | flushing ring |
| 19 | ring nozzle |
| 20 | nozzle opening |
| 21 | arrow |
| 22 | arrow |
| 23 | arrow |
| 24 | arrow |
| 25 | connection |
| 26 | line |
| 27 | water pipe |
| 28 | flushing tank |
| 29 | pump |
| 30 | distributing device |
| 31 | first valve |
| 32 | second valve |
| 33 | third valve |
| 34 | first line |
| 35 | second line |
| 36 | third line |
| 37 | arrow |
| 38 | arrow |
| 39 | arrow |
| 40 | arrow |
| 41 | volume curve |
| 42 | pressure curve |
| 43 | flushing water |
| 44 | line |
| 45 | motor |
| 46 | line |
| 47 | branch junction |
| 48 | line |
| 49 | turbine |
| 50 | inlet valve |
| 51 | line |
| 52 | energy store |
| 53 | pump |
| 54 | piston |
| 55 | holding element |
| 56 | line |
| 57 | line |
| 58 | non-return valve |
| 59 | non-return valve |
| 60 | reservoir |
| 61 | reservoir |
| 62 | non-return valve |
| 63 | non-return valve |

-continued

| REFERENCE SYMBOL LIST | |
|---|---|
| 64 | outlet |
| 65 | connecting socket |
| 66 | connecting socket |
| 67 | line |
| 68 | line |
| 69 | trap water |
| 70 | point |
| 71 | inner side |
| 72 | point |
| 73 | spring |
| 74 | arrow |
| 75 | interior space |
| 76 | water |
| 77 | water |
| 78 | air |
| 79 | air |
| A | upper region |
| B | middle region |
| C | lower region |

The invention claimed is:

1. A water closet comprising a toilet bowl and a flushing device for flushing the toilet bowl, wherein said flushing device comprising a flushing tank, from which a quantity of flushing water can be fed to the toilet bowl, this flushing water quantity being divided into a first part-quantity, a second part-quantity and a third part-quantity, wherein with a first part-quantity at least an upper region of the inner side of the toilet bowl, and with a second part-quantity a middle region of the inner side of the toilet bowl, and with a third part-quantity a siphon trap of the toilet bowl is flushable and can be cleaned, wherein for the division of the quantity of flushing water a distributing device is provided, with which the flushing water is divided in said part-quantities, wherein the distributing device has a branch junction at which the flushing water quantity is divided, whereupon the first part-quantity of water is fed to a first valve, the second part-quantity of water is fed to a second valve and the third part-quantity of water is fed to a third valve, wherein the toilet bowl has a first inlet for the first part-quantity which first inlet is associated to the first valve, a second inlet for the second part-quantity which second inlet is associated to the second valve and a third inlet for the third part-quantity of the flushing water which third inlet is associated to the third valve, wherein the toilet bowl has for the first part-quantity first outlet openings which are associated to the first inlet, for the second part-quantity second outlet openings which are associated to the second inlet and for the third part-quantity third outlet openings which are associated to the third inlet, wherein that part-quantity of the flushing water which is delivered through the first outlet openings wets an upper region and a middle region of the inner side of the toilet bowl in order to clean these two regions, wherein the second outlet openings are nozzle openings of a flushing channel and these nozzle openings are disposed in an upper rim of the toilet bowl, these nozzle openings being directed towards a middle region of the inner side of the toilet bowl in order to clean this region in the event of a flush, and wherein for the delivery of the third part-quantity a ring nozzle which is arranged in a lower region of the toilet bowl is provided.

2. The water closet according to claim 1, wherein the second part-quantity can be delivered to the toilet bowl with a higher pressure than the first part-quantity, and the third part-quantity with a higher pressure than the second part-quantity.

3. The water closet according to claim 1, wherein in the event of a flush, the first part-quantity can be delivered into the toilet bowl by virtue of gravitational force or a height difference.

4. The water closet according to claim 1, wherein it has at least one pump, which serves to deliver at least one of the said part-quantities under pressure to the toilet bowl.

5. The water closet according to claim 1, wherein the pump is actuated with a motor or by means of a turbine disposed in a pressure line.

6. The water closet according to claim 1, wherein the volume of the second part-quantity is greater than the volume of the first part-quantity, and the volume of the third part-quantity is greater than the volume of the second part-quantity.

7. The water closet according to claim 1, wherein the first part-quantity is delivered with a pressure less than 0.3 bar, preferably equal to or less than 0.2 bar, and yet more preferably equal to or less than 0.1 bar.

8. The water closet according to claim 1, wherein the second part-quantity is delivered with a pressure between 0.1 and 0.6 bar, preferably with a pressure between 0.2 and 0.4 bar.

9. The water closet according to claim 1, wherein that substantially the total quantity of flushing water is stored under pressure.

10. A toilet bowl for a water closet according to claim 1, having means for the connection of a flushing device; a rim forming an opening; a downward-tapering inner side; and a siphon trap having an outlet opening, wherein it has for a flushing operation at least three outlets, a first outlet being intended for the cleaning of at least a first upper region, a second outlet for the cleaning of a middle region and a third outlet for the flushing and cleaning of the siphon trap.

11. The toilet bowl according to claim 10, wherein the first outlet is formed by a flushing ring.

12. The toilet bowl according to claim 10, wherein the means for the connection of a flushing device have at least two connecting sockets.

* * * * *